US011384705B2

(12) United States Patent
Dussardier

(10) Patent No.: US 11,384,705 B2
(45) Date of Patent: Jul. 12, 2022

(54) DETERMINING A DRIFT IN THE FUEL STATIC FLOW RATE OF A PIEZOELECTRIC INJECTOR OF A MOTOR VEHICLE HEAT ENGINE

(71) Applicant: VITESCO TECHNOLOGIES GMBH, Hannover (DE)

(72) Inventor: Quentin Dussardier, Toulouse (FR)

(73) Assignee: VITESCO TECHNOLOGIES GMBH, Hannover (DE)

( * ) Notice: Subject to any disclaimer, the term of this patent is extended or adjusted under 35 U.S.C. 154(b) by 0 days.

(21) Appl. No.: 17/430,941

(22) PCT Filed: Mar. 27, 2020

(86) PCT No.: PCT/EP2020/058867
§ 371 (c)(1),
(2) Date: Aug. 13, 2021

(87) PCT Pub. No.: WO2020/193795
PCT Pub. Date: Oct. 1, 2020

(65) Prior Publication Data

US 2022/0128015 A1 Apr. 28, 2022

(30) Foreign Application Priority Data

Mar. 28, 2019 (FR) ..... 1903238

(51) Int. Cl.
*F02D 41/20* (2006.01)
*F02D 41/14* (2006.01)
(Continued)

(52) U.S. Cl.
CPC ..... *F02D 41/2096* (2013.01); *F02D 41/1401* (2013.01); *F02D 41/22* (2013.01);
(Continued)

(58) Field of Classification Search
CPC .. F02D 41/2096; F02D 41/1401; F02D 41/22; F02D 41/2467; F02D 41/221;
(Continued)

(56) References Cited

U.S. PATENT DOCUMENTS 6,353,791 B1 3/2002 Tuken et al.
8,820,151 B2 9/2014 Ito et al.
(Continued)

FOREIGN PATENT DOCUMENTS

DE 10 2014 208 874 11/2015
DE 10 2015 205 877 10/2016
(Continued)

OTHER PUBLICATIONS

International Search Report and Written Opinion of the ISA for PCT/EP2020/058867 dated Jul. 17, 2020, 13 pages.

*Primary Examiner* — George C Jin
(74) *Attorney, Agent, or Firm* — Nixon & Vanderhye

(57) ABSTRACT

The disclosure relates to a method for determining a drift in the static fuel flow rate of a piezoelectric injector of a motor vehicle combustion engine. The method relies on fluid-pressure measurements carried out in the injector supply chamber in order to calculate a measured static flow rate value. This value is compared against a nominal static flow rate in order to determine the existence, if any, and amplitude of the drift in the static flow rate. Furthermore, each pressure measurement is carried out when the valve of the injector is closed and the injector is open. In this way, the measured static flow rate calculation is not influenced by pressure-variation effects not relevant to the measurement.

20 Claims, 4 Drawing Sheets

(51) Int. Cl.
*F02D 41/22* (2006.01)
*F02D 41/24* (2006.01)

(52) U.S. Cl.
CPC .. *F02D 41/2467* (2013.01); *F02D 2041/1433* (2013.01); *F02D 2041/2048* (2013.01); *F02D 2041/224* (2013.01); *F02D 2200/023* (2013.01); *F02D 2200/0602* (2013.01); *F02D 2200/0606* (2013.01); *F02D 2200/0616* (2013.01)

(58) Field of Classification Search
CPC ..... F02D 2041/1433; F02D 2041/2048; F02D 2041/224; F02D 2200/023; F02D 2200/0602; F02D 2200/0606; F02D 2200/0616
See application file for complete search history.

(56) References Cited

U.S. PATENT DOCUMENTS

| | | | | |
|---|---|---|---|---|
| 10,378,474 | B2 | 8/2019 | Hirchenhein et al. | |
| 10,578,043 | B2 | 3/2020 | Hirchenhein et al. | |
| 10,598,116 | B2 | 3/2020 | Hirchenhein et al. | |
| 2014/0216409 | A1 | 8/2014 | Katsura | |
| 2015/0369187 | A1* | 12/2015 | Leblon | F02M 51/0603 239/5 |
| 2016/0333815 | A1 | 11/2016 | Ulrey et al. | |
| 2017/0363036 | A1 | 12/2017 | Okamoto | |
| 2018/0017010 | A1 | 1/2018 | Nieddu et al. | |
| 2020/0309056 | A1* | 10/2020 | Fujisaki | F02D 41/26 |
| 2021/0341347 | A1* | 11/2021 | Fujisaki | G01L 23/10 |

FOREIGN PATENT DOCUMENTS

| | | |
|---|---|---|
| DE | 10 2015 214 815 | 2/2017 |
| DE | 10 2015 214 817 | 2/2017 |
| DE | 10 2016 211 551 | 12/2017 |
| DE | 10 2016 214 464 | 2/2018 |
| EP | 2 649 286 | 10/2013 |
| JP | 2017-160916 | 9/2017 |
| WO | 2012/077584 | 6/2012 |
| WO | 2014/039800 | 3/2014 |
| WO | 2018/015091 | 1/2018 |

* cited by examiner

DETERMINING A DRIFT IN THE FUEL STATIC FLOW RATE OF A PIEZOELECTRIC INJECTOR OF A MOTOR VEHICLE HEAT ENGINE

BACKGROUND OF THE INVENTION

Field of the Invention

The present invention relates in general to motor vehicle combustion engine fuel injection systems.

It relates more particularly to a method for determining a drift in the static fuel flow rate of a piezoelectric injector of a motor vehicle combustion engine.

Description of the Related Art

In motor vehicles with combustion engines, whether these are fueled with diesel oil or with gasoline, the injection system is often affected, in the fairly long term, by a drift in the quantity of fuel atomized by the injectors during injections.

An injector has the function of releasing a jet of fuel required to supply the engine with fuel. The duration of this jet, which is referred to as the injection time, is controlled electrically by the engine management computer, according to parameters acquired by sensors (engine temperature, throttle pedal position, engine load determined by the pressure of the air in the air intake, etc.). The injector tip comprises a nozzle closed by a needle, and the upper part of the injector houses an electromechanical system controlled by the computer, which lifts the needle off its seat to bring about injection.

The injectors are the main source of this drift as they suffer from phenomena of corrosion or fouling. Specifically, the corrosion of an injector nozzle leads to an uncontrolled increase in the quantity of fuel injected for a given injection command. Conversely, the fouling of an injector nozzle leads to an uncontrolled reduction in the quantity of fuel injected for a given injection command. More specifically, the corrosion and the fouling of the nozzle modify the value of the static flow rate of the injector, namely the maximum value that the flow rate reaches during a phase of complete opening of the injector, namely during an injection. This value tends to increase in the case of corrosion and tends to decrease in the case of fouling of the nozzle.

In either one of these instances, the effects of this drift are highly detrimental to the overall performance of the vehicle. On the one hand, they lead to a drift in the engine torque generated with respect to that which is expected and, on the other hand, they lead to increased emissions of pollutant gases, either directly in the case of an increase in the static flow rate, or indirectly as a result of the impaired engine performance.

Of the various types of injector employed in motor vehicle combustion engine injection systems, the use of injectors referred to as piezoelectric injectors is very widespread. One essential characteristic feature of such injectors lies in their use of an electrohydraulic valve also referred to as a servo valve. The purpose of this is to cause the injector to open or to close. More specifically, the injector is kept closed by default under the effect of the pressurized fuel in the supply circuit. Each opening of the electrohydraulic valve creates a deliberate leakage of fuel which in turn causes the injector to open and therefore causes fuel to be injected into the relevant combustion chamber of the engine. The piezoinjector name derives from the fact that the valve is actuated by a piezoelectric actuator controlled by a voltage command. In summary, a voltage pulse is applied to the piezoelectric actuator of the valve to open it, and, after a certain delay, the injector opens as a knock-on effect.

Furthermore, it is well known that when injectors of this type becomes degraded (i.e. corroded or fouled), an intrinsic physical effect has a tendency to compensate for the drift in the quantity of fuel injected. Specifically, when the static flow rate of the injector decreases under the effect of the fouling of the holes in the nozzle, the total duration of the phase for which the injector is open tends to lengthen. Conversely, when the static flow rate of the injector increases under the effect of the corroding of the holes, the total duration of the phase for which the injector is open tends to shorten. In this way, the quantity injected is less significantly affected by the injector degradation.

However, with a view to minimizing potential spread in the behavior of various injection systems and to reducing potential drift in the instant of closing of these injectors, certain injection systems also incorporate means for controlling the instant of closure of the injectors. In these systems, the instant of closure of an injector is determined not only indirectly from the instant of closure of its valve (after a determined delay) but rather by an active system which precisely commands the instant of closure of the valve. In such cases, the total duration of a phase for which an injector is open is not truly impacted by potential degradation of the injector nozzle and in such an injection system the drift in the static flow rate of an injector as a result of injector degradation over time actually directly leads to an increase in the quantity of fuel injected in the case of corrosion and to a decrease in the quantity of fuel injected in the case of fouling.

It is undoubtedly for this reason that no mechanism is usually provided for compensating for a potential modification in the quantity of fuel injected as a result of injector degradation over time. The constant search for better combustion engine performance in order in particular to limit fuel consumption and pollutant gas emissions is, however, leading to a need to detect and/or to correct the drift in the static fuel flow rate of an injector.

In order to correct or detect the drift in the fuel flow rate of an injector, notably the static flow rate, certain existing solutions employ additional sensors in the injection system. These sensors allow detection of the potential variations in the total duration of the phase for which the injector is open, in the static flow rate of the injector, or else in the instant of closure of the injector. They rely, for example, on a pressure sensor, an optical sensor, or else an electrical-contact sensor, these sensors being specifically incorporated into the injection system.

Other solutions involve exploiting the sensors already present in the injection system or in the engine. For example, it is possible to detect a drift in flow rate from pressure measurements carried out by a pressure sensor situated in the injector supply chamber of such an injection system. Such a solution enables the determination of the errors in static flow rate or in quantity injected on the basis of the drop in pressure associated with an opening of an injector and on the basis of the duration of this drop in pressure.

For example, patent application WO201805091 discloses a method that relies upon the drop in pressure measured throughout the duration of the phase for which the injector is open in order to determine a drift in flow rate of the injector. However, this solution takes into consideration the entirety of a pressure drop brought about by an injection. In particular, it therefore also takes account of the effect of the fuel leaks associated with the opening of the electrohydraulic valve in the case of piezoelectric injectors. Finally, the determination of a potential drift in the quantity of fuel injected can therefore be impaired or even corrupted by the incorporation of non-relevant effects into the calculation of the static flow rate of the injector.

SUMMARY OF THE INVENTION

The invention seeks to reduce the aforementioned disadvantages of the prior art by allowing the drift in the static flow rate of a piezoelectric injector to be determined without resorting to an additional sensor and by exploiting only measured data that is relevant, so as to ensure the good precision of this determination.

To this end, a first aspect of the invention proposes a method for determining a drift in the static fuel flow rate of a piezoelectric injector of a motor vehicle combustion engine, said injector comprising an electrohydraulic valve of the servo valve type designed to cause the injector to open or to close, said method comprising the following steps, executed by a control unit when the injector is open and the electrohydraulic valve is closed:

a) acquisition of at least two pressure values $P_1$ and $P_2$, measured by a pressure sensor in a supply chamber of the injector at at least two respectively associated different instants $t_1$ and $t_2$;

b) calculation, from the acquired pressure values and the respectively associated instants, of a gradient of pressure with respect to time dP;

c) calculation of a measured static flow rate $Q_{meas}$ of which the value is equal to the gradient of pressure with respect to time dP multiplied by a first determined value $V_{sys}$ corresponding to the total volume of the fuel pressurized and divided by a second determined value K corresponding to the elastic modulus of the fuel; and d) determination of a value representative of the drift in the static flow rate $Q_{ratio}$, which value is proportional to the ratio of the measured static flow rate $Q_{mes}$ to a third determined value $Q_{nominal}$ corresponding to the nominal flow rate of the injector within the range of pressure values of the gradient of pressure with respect to time dP, and storage, in a memory of the control unit, of an information item representative of the drift in the static flow rate which information item is associated with said value representative of the drift in the static flow rate.

Embodiments taken individually or in combination further provide that:

- the method further comprises, prior to execution of steps a), b), c) and d) of the method, the checking, by the control unit, of a plurality of conditions of activation of the method and wherein steps a), b), c) and d) of the method are executed if, and only if, all of the conditions of execution of the method are met.
- the conditions of execution of the method comprise:
- the fact that the temperature TCO of the water in the cooling circuit has a value comprised between determined limit values;
- the fact that the temperature of the fuel has a value comprised between determined limit values;
- the fact that the pressure of the fuel has a value comprised between determined limit values;
- the fact that the quantity of fuel required for injection has a value comprised between determined limit values; and
- the fact that the angular position of the crankshaft of the combustion engine has a value comprised between determined limit values.
- the method further comprises, prior to execution of steps a), b), c) and d) of the method, on the basis of a determined injection command from the control unit, comparison of the theoretical duration comprised between the closing of the electrohydraulic valve and the closing of the injector against a determined threshold value, and wherein steps a), b), c) and d) of the method are executed if, and only if, said theoretical duration is greater than said determined threshold value.
- during step c), the pressure gradient with respect to time is calculated using a calculation method employing a linear regression model.
- the method further comprises, consecutive to step d), the carrying-out, by the control unit, of a flow rate regulating action such as modifying, within an injection command, the total quantity of fuel to be injected, the total duration for which the injector is open, or the injection pressure.
- the value representative of the drift in the static flow rate $Q_{ratio}$, is calculated as being the value of the measured static flow rate $Q_{mes}$ divided by the determined value $Q_{nominal}$ corresponding to the nominal flow rate of the injector within the range of pressure values of the gradient of pressure with respect to time dP.
- the determined value $Q_{nominal}$ corresponding to the nominal flow rate of the injector within the range of pressure values of the gradient of pressure with respect to time dP is obtained from laboratory characterization of the properties of a plurality of injectors substantially identical to the injector that is the subject of the steps of the method.
- the value representative of the drift in the static flow rate $Q_{ratio}$ is calculated as the total measured area of the injector holes $A_{mes}$ divided by the total nominal area of the injector holes $A_{nominal}$, and wherein the value of said total measured area of the injector holes $A_{mes}$ is equal to $A_{mes}=Q_{mes}/Cd\times\sqrt{(\rho/(2\times\Delta P))}$, where Cd is the coefficient of discharge characterizing the efficiency of the flow, ρ is the density of the fuel which is dependent on the temperature and on the pressure of the fuel, and ΔP is the difference between the pressure measured in the supply chamber and that measured in the combustion chamber and said total nominal area of the injector holes $A_{nominal}$ is determined from data supplied by the injector manufacturer.
- during step a), the acquisition of pressure values is carried out throughout the duration comprised between the closing of the electrohydraulic valve and the closing of the injector, at a determined acquisition frequency.

In a second aspect, the invention also relates to a device for determining a drift in the static fuel flow rate of a piezoelectric injector of a motor vehicle combustion engine, said injector comprising an electrohydraulic valve of the servo valve type designed to cause the injector to open or to close, said device comprising a control unit, a pressure sensor in a supply chamber of the injector, said control unit comprising means for implementing all the steps of the method according to the first aspect.

In a third aspect, the invention also relates to a computer program product comprising instructions which, when the computer program is loaded into the memory of a device according to the invention and is executed by a processor of said device, cause the computer to implement all the steps of the method according to the first aspect.

In a fourth aspect, the invention also relates to an injection system comprising a pump, a connecting line, a supply chamber, a supply line, a piezoinjector and a control unit all suited to implementing all the steps of the method according to the first aspect.

BRIEF DESCRIPTION OF THE DRAWINGS

Other features and advantages of the invention will become more apparent upon reading the following description. This description is purely illustrative and must be read with reference to the attached drawings, in which.

DESCRIPTION OF THE PREFERRED EMBODIMENTS

Figure 1:
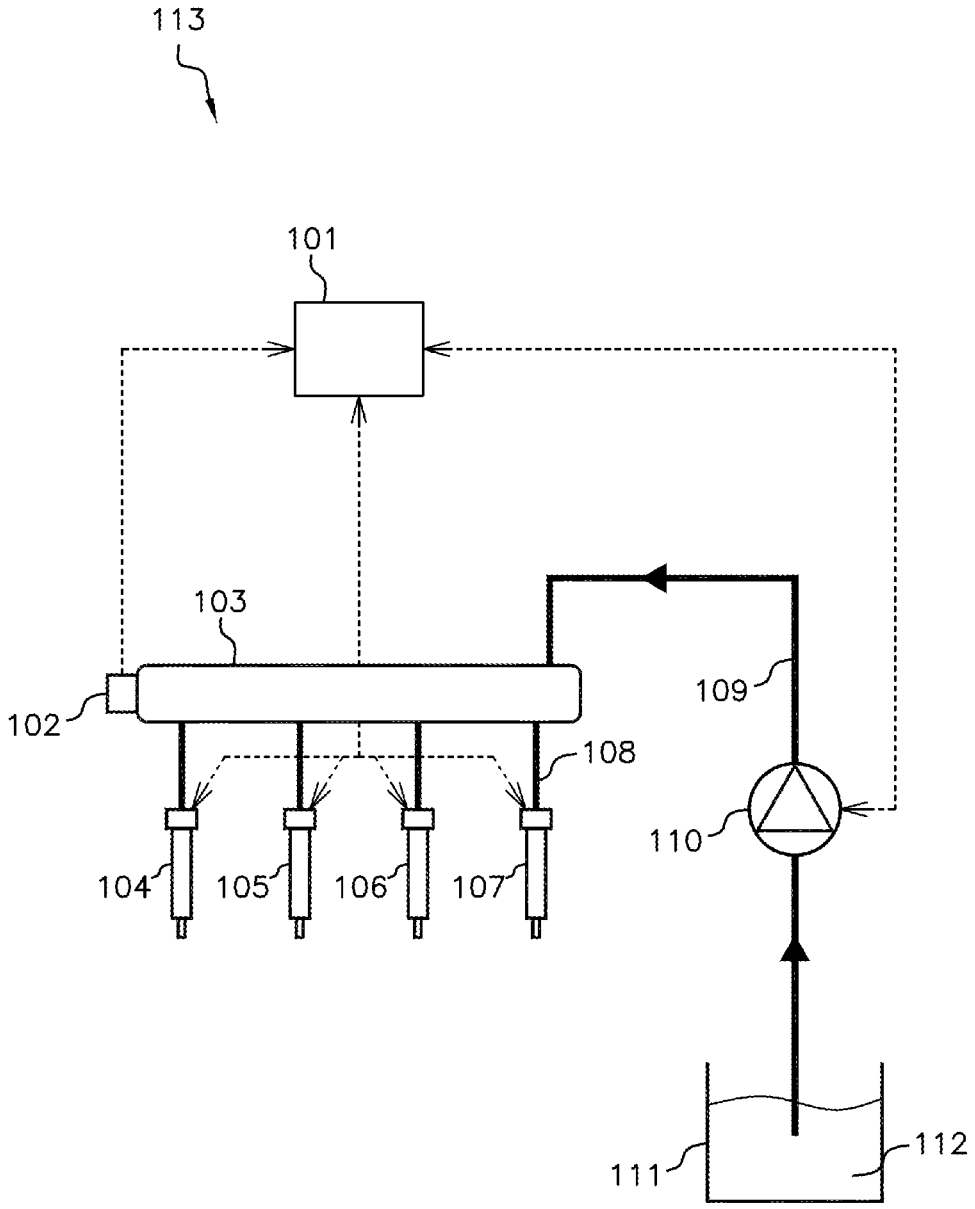
FIG. 1 is a schematic depiction of one embodiment of an injection system in which the method according to the invention can be implemented.

In the following description of the embodiments and in the figures of the attached drawings, the same or similar elements have the same numerical reference signs in the drawings.

FIG. 1 shows a schematic depiction of one embodiment of a motor vehicle combustion engine injection system in which the method according to the invention can be implemented. The injection system 113 depicted is, from a structural standpoint, in accordance with the prior art.

In the example depicted, the fuel 112, taken from the tank 111, is pressurized to a high pressure by a pump 110. The fluid (i.e. the fuel) under high pressure circulates along a connecting line 109 to a common supply chamber 103, also referred to as common rail, which serves all of the piezoinjectors 104, 105, 106 and 107 of the engine. These piezoinjectors operate in accordance with the description given in the introduction, and this operation will be described in greater detail later, with reference to FIG. 2. Furthermore, a person skilled in the art will appreciate that the number of injectors in such a system is not necessarily restricted to four as in the example depicted, but may be equal to any number suitable for allowing correct operation of a combustion engine equipped with the injection system concerned, notably according to the number of engine cylinders (combustion chambers).

Each piezoinjector is connected to the common supply chamber 103 by a specific supply line. For example, the supply line 108 connects the piezoinjector 107 to the supply chamber 103. Furthermore, with regard to the piezoinjector 107, the supply line 108, the supply chamber 103, the connecting line 109 and the internal passage 204 (depicted in FIG. 2) of the injector contain the volume of fuel pressurized to a high pressure which contributes to keeping the injector closed as its default status. Additionally, a pressure sensor 102 allows measurement of the pressure of the fluid inside the supply chamber. Finally, the control unit 101 operates the entire injection system by commanding the pump and the injectors in particular. Furthermore, the control unit 101 receives and also processes information originating from the pressure sensor 102.

Figure 2:
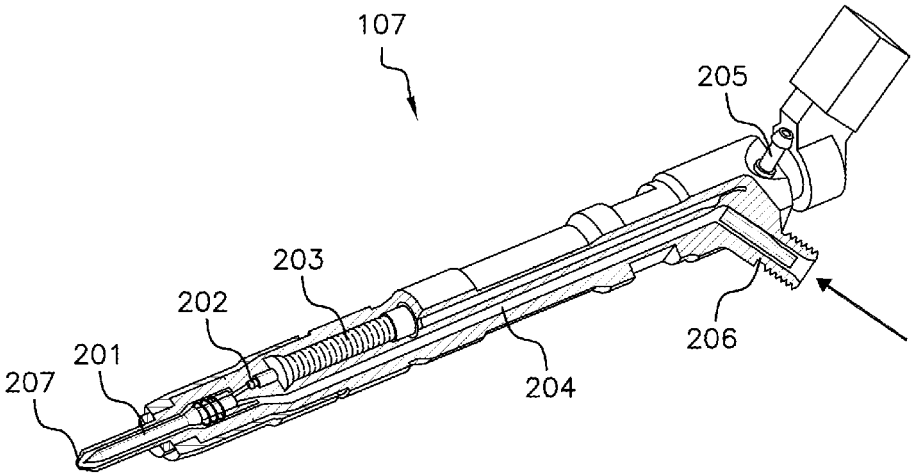
FIG. 2 is a view in perspective and partial-section of a piezoelectric injector according to one embodiment of the invention.

FIG. 2 shows a view in perspective and partial-section of a piezoelectric injector according to one embodiment of the invention. The piezoinjector 107 depicted is structurally in accordance with the prior art.

In the example depicted, the piezoinjector 107 is supplied with fuel under high pressure via its opening 206. When no command to open the injector is received, the fuel under high pressure, present in the internal passage 204, applies pressure to the needle 201 which closes the injector at the tip 207 thereof. By contrast, when a voltage command is transmitted to the piezoelectric actuator 203 by the engine management computer, this actuator moves in such a way as to cause the valve 202 to open. Some of the fluid then spills back along the injector via a specific passage (not visible in the injector) and leaves same at the outlet 205. This fluid may, for example, be directed back to the pump 110 of the injection system 113.

In all cases, the discharging of a determined quantity of fluid reduces the pressure applied on the needle 201 which moves in its chamber and causes the injector to open at its tip 207. It is this opening that allows the release of a determined quantity of fuel into the combustion chamber (not depicted) of the engine.

Figure 3:
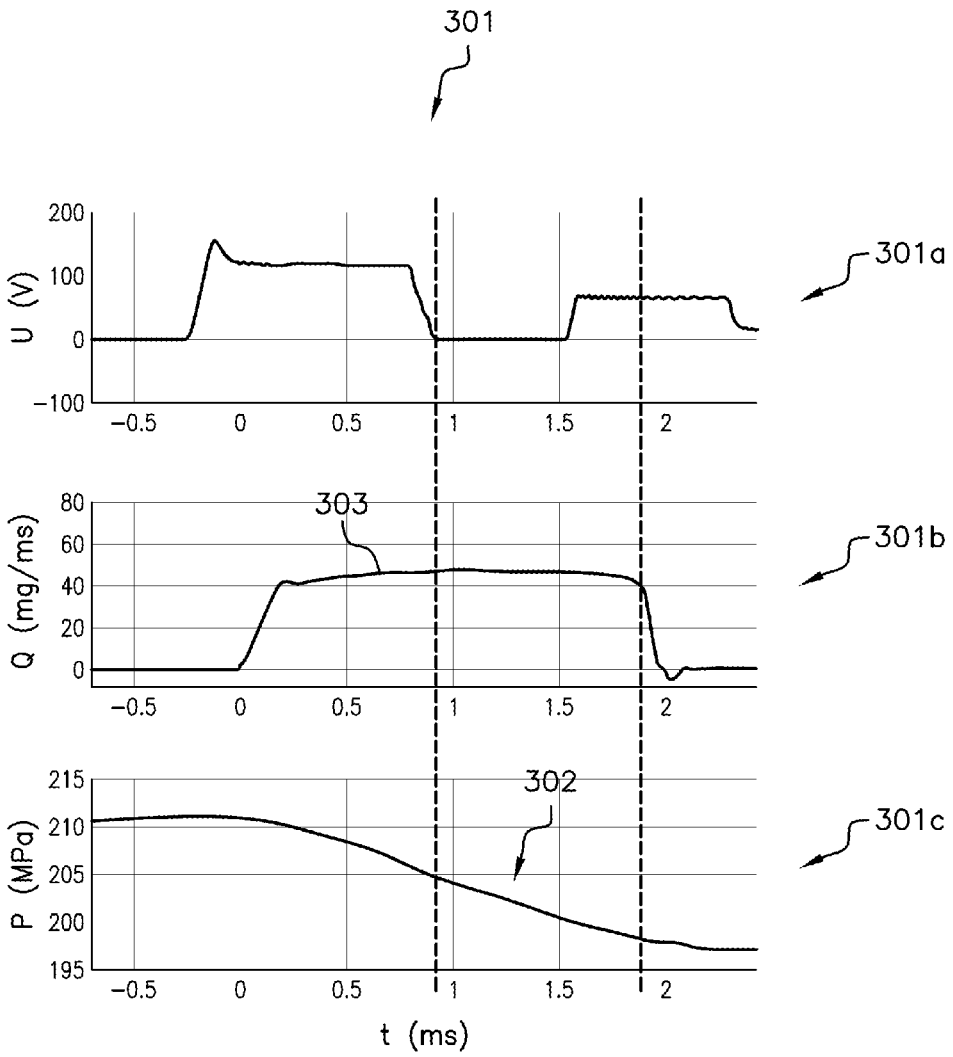
FIG. 3 is a set of curves indicative of the evolution with respect to time of characteristic properties in the operation of a piezoelectric injector according to one embodiment of the invention.

The graph of FIG. 3 shows a set of curves indicative of the evolution with respect to time of characteristic properties in the operation of a piezoelectric injector (as described with reference to FIG. 2) in which the method according to the invention can be implemented. The three curves depicted, 301*a*, 301*b* and 301*c*, respectively illustrate the measured evolution with respect to time of three distinct properties during a phase in which the injector is open (i.e. during an injection). In particular, curve 301*a* represents the evolution with respect to time of the voltage command applied to the piezoelectric actuator 203, curve 301*b* represents the evolution with respect to time of the injector flow rate through the tip 207 of said injector, and curve 301*c* represents the evolution with respect to time of the pressure measured by the supply chamber pressure sensor.

A person skilled in the art will appreciate that a time offset (i.e. a delay) has been applied to the depiction 301*c* of the evolution of the pressure with respect to time, for the purposes of legibility, and more particularly to correct the hydraulic delay associated with the travel of the fluid along the various lines. Specifically, because the pressure sensor is situated in the supply chamber at a determined (and known) distance from the tip of the injector, the time taken for the fluid to travel introduces a time offset between an event that occurs at the tip of the injector and the impact that this has when passed on to the pressure sensor. More specifically, such a hydraulic travel time delay between the tip of the injector and the pressure sensor is characterized in the laboratory, and may be dependent on the fuel pressure and temperature, but also on the distance between the tip of the injector and the sensor, which varies according to the position of the injector along the supply chamber. In all cases, this type of delay is well known to those skilled in the art who will know how to take this into consideration in the calculations described later on by adapting these to suit the precise topology and volumetric characteristics of the injection system concerned.

Curve 301*a* shows, in its left-hand part, a first voltage pulse characteristic of the command to open the electrohydraulic valve. This pulse causes the piezoelectric actuator to move and, in consequence, causes the resultant opening of the valve. The second voltage pulse that appears in the right-hand part of the curve is associated with another use of the valve that in particular allows said valve to be used to detect the closing of the injector as appropriate. As this use does not form part of the implementations of the invention, it is not the subject of a more in-depth explanation in the context of the present description.

Curve 301*b* shows the evolution with respect to time of the flow rate of the injector as physically measured by an external measurement device. The instantaneous injection flow rate is also known by the abbreviation ROI (Rate Of Injection). The pulse depicted is derived directly from the pulse associated with the opening of the valve with different delays between the respective openings and closings of the valve and of the injector. The static flow rate of the injector is therefore the maximum value 303 that the flow rate reaches during an injection phase.

Finally, curve 301*c* shows the reduction in the pressure value measured in the supply chamber during the course of this same phase. As was already mentioned hereinabove, the idea behind the method according to the invention is that of using this measurement to determine the static flow rate of the injector and, thereafter, any potential drift therein. In particular, the method uses only the measured pressure values that are comprised within the part 302 (demarcated by dotted lines) of curve 301*c*, namely when the valve is closed and the injector is still open. In this way, the pressure values (and their evolutions over the course of time) that are used are due only to the opening of the injector and not to that of the valve.

Furthermore, the person skilled in the art will appreciate that, in the example depicted, the phase for which the injector is open occurs when the pressure value is initially high and stable. In other words, the injection and, incidentally, the determination of the static flow rate, are carried out when the pump of the injection system has already raised the fuel in the supply chamber to a high pressure. As a preference, the steps of the method are executed when the pumping phase has finished, so that the pressure in the supply chamber is established with a stable value. This form of embodiment is simpler. However, in an alternative embodiment, provision may be made to employ modeling of the rise in pressure in order to allow the drift in the static flow rate to be determined even during a pumping (i.e. increasing-pressure) phase.

Figure 4:
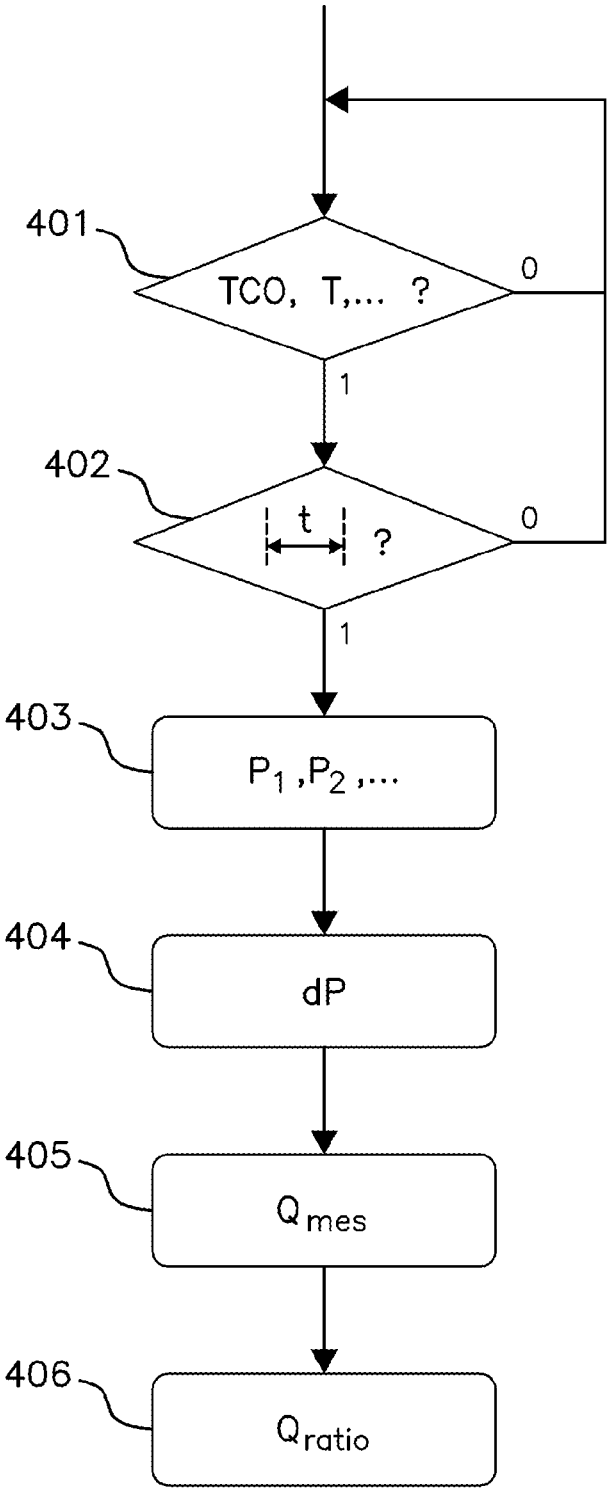
FIG. 4 is a diagram of steps of an embodiment of the method according to the invention.

FIG. 4 shows a diagram of steps illustrating one embodiment of the method according to the invention. All the steps of the method are executed by a control unit such as the control unit 101 of the injection system 113 depicted in FIG. 1. Such a control unit may, for example, be an engine management computer or ECU (Engine Control Unit) which in general terms manages the operation of the engine.

Step 401 is a preliminary step which consists in checking a plurality of conditions known as the method-execution conditions. What this means to say is conditions that have to be met before the subsequent steps of the method can potentially be executed. What is meant by checking here is determining whether or not a condition is met. Advantageously, this checking allows the drift in the static flow right of the injector to be determined under conditions that ensure a satisfactory level of performance.

To this end, the control unit exploits information originating from sensors or components of the engine in order to make an advance estimation as to the possibility of determining the static fuel flow rate with precision. For example, in a particular embodiment of the method, the control unit checks the following conditions:

- that the temperature TCO (Temperature of COoling) of the water in the cooling circuit has a value comprised between determined limit values. This condition is connected with the precision of the calculations, performed in the execution of the method, which are dependent on this value.
- that the temperature of the fuel has a value comprised between determined limit values. This check allows the other steps of the method to be executed only when the engine is hot.
- that the pressure of the fuel has a value comprised between determined limit values. This check is connected with the signal-to-noise ratio which is better when the pressure values used for the calculation are high.
- that the quantity of fuel required in an injection command has a value comprised between determined limit values. This check is to ensure that the minimum time duration needed for performing the calculation is available.
- that the angular position of the crankshaft of the combustion engine has a value comprised between determined limit values. This condition is also equivalent to checking that the pumping phase has actually finished.

During step 402, the control unit compares the theoretical duration of the interval of time between the closing of the electrohydraulic valve and the closing of the injector against a predetermined threshold value. What is meant by a theoretical duration is the duration expected on the basis of the known characteristics of the injection command. In particular, the control unit knows, for each injection command, associated with a specific engine operating point, this theoretical duration. Thus, in the same way as was employed for checking in step 401, the following steps of the method are executed if, and only if, this theoretical duration is greater than the chosen threshold value. This step also, advantageously, ensures that the exploitable measured pressure values will allow correct determination of the static flow rate of the injector. In particular, the precision of the static flow rate calculation described later on is all the better if based on a sufficiently high number of pressure values. Now, as is known per se, each pressure sensor operates with a limited acquisition frequency. Thus, the longer the exploitable measurement duration, the better will be the precision of the calculation.

A person skilled in the art will appreciate that the exemplary embodiment described in the foregoing is nonlimiting and that, moreover, steps 401 and 402 of the method may be executed concomitantly or in any order. In addition, the reader will not fail to notice that all the following steps of the method are executed only when the injector is open and the electrohydraulic valve is closed.

Step 403 consists in acquiring pressure values, measured by the pressure sensor situated in the injector supply chamber. The calculation of the static flow rate using these values requires at minimum two values measured at two distinct instants. However, as has already been mentioned, the higher the number thereof, the better the precision. Thus, the optimal measurement scenario is that in which pressure values are required as soon as the valve closes and right up to the closing of the injector. This measurement is performed with due consideration given to the hydraulic travel delay already mentioned regarding the travel between the tip of the injector and the pressure sensor. For example, for injection systems in which the closing of the injector is controlled or detected, the acquisition of pressure values may be carried out throughout the duration comprised between the closing of the electrohydraulic valve and the closing of the injector (at the determined acquisition frequency specific to the pressure sensor used). By contrast, in instances in which the precise instant of closure of the injector is not known, the acquisition of pressure values may be carried out, with the same acquisition frequency, for a determined duration starting from the closing of the valve. This duration needs to be chosen both so that it is considered to be sufficient to ensure that the number of pressure value acquisitions is high enough, but without being too great, in order to guarantee that the measurement is taking place while the injector is still open.

During step 404, the control unit calculates a pressure gradient with respect to time from the pressure values measured during the previous step. The gradient with respect to time, $\delta P/\delta t$, is denoted dP hereinafter in order to simplify the description.

In one particular embodiment of the method, the gradient of pressure with respect to time dP is calculated using a calculation method employing a linear regression model. In a way known per se, linear regression allows the determination of the relationship between a variable referred to as the explained variable (in this instance the pressure P) and an explanatory variable (in this case the time t). The simplest model consists for example in modeling the gradient, on the basis of the measured values, using a linear relationship, i.e. a straight line.

Step 405 therefore comprises the calculation of a measured static flow rate denoted $Q_{mes}$, using the formula:

$$Q_{mes} = \frac{dP \times V_{sys}}{K} \quad \text{[Math. 1]}$$

where $V_{sys}$ corresponds to the volume of the high-pressure system, namely to the total volume of the fuel raised to high pressure, and K is a linear constant corresponding to the elastic modulus of the fuel. As is known per se by those skilled in the art, this elastic modulus is dependent on the measured pressure of the fuel and on the temperature of this fuel. The person skilled in the art will know how to determine these values in order to use an exact value of the elastic modulus of the fuel in the calculation of the static flow rate. For example, the pressure value used may be the one measured by the supply chamber pressure sensor and the temperature value may be the one measured by a temperature sensor present in the injection system.

Finally, step 406 consists in determining a value representative of the drift in the static flow rate referred to as $Q_{ratio}$ which is proportional to the ratio of the measured static flow rate $Q_{mes}$ to a so-called nominal static flow rate of the injector $Q_{nominal}$. Furthermore, the person skilled in the art will appreciate that the value of the static flow rate $Q_{ratio}$ has to be calculated using a measured static flow rate $Q_{mes}$ and a nominal static flow rate $Q_{nominal}$ which are both considered for the same range of pressure values. Stated differently, the nominal static flow rate $Q_{nominal}$ used for the calculation is the nominal static flow rate determined within the range of pressure values of the gradient of pressure with respect to time dP.

In one nonlimiting embodiment, this value representative of the drift in the static flow rate $Q_{ratio}$ is simply equal to the value of the measured static flow rate $Q_{mes}$ divided by the determined nominal static flow rate value $Q_{nominal}$ within the range of pressure values of the gradient of pressure with respect to time dP. Furthermore, the nominal static flow rate value is known in advance, on the basis, for example, of a laboratory characterization of the properties of a plurality of injectors substantially identical to the injector concerned.

In another embodiment of the method, the value representative of the drift in the static flow rate $Q_{ratio}$ is determined using the following formula:

$$Q_{ratio} = \frac{A_{mes}}{A_{nominal}} \quad \text{[Math. 2]}$$

where $A_{mes}$ is the measured total area of the injector holes which is calculated from the measured static flow rate value and $A_{nominal}$ is the nominal total area of the injector holes, determined from data supplied by the injector manufacturer.

In particular, the measured total area of the holes is calculated using the formula:

$$A_{mes} = \frac{Q_{mes}}{Cd} \times \sqrt{\frac{\rho}{2 \times \Delta P}} \quad \text{[Math. 3]}$$

where Cd is the coefficient of discharge characterizing the efficiency of the flow, ρ is the density of the fuel which is dependent on the temperature and on the pressure of the fuel, and ΔP is the difference between the pressure measured in the supply chamber and that measured in the combustion chamber. All of these values are known per se to those skilled in the art, who will know how to adapt them to suit a particular injection system in order to determine the true measured total area of the holes of a given injector.

Whatever the approach used, the value representative of the determined drift in the static flow rate can be associated with an information item representative of the drift in the static flow rate. For example, if the drift is above a threshold value, it is considered to be critical, namely to have a significant impact on the operation of the engine. Thus, in one embodiment of the method, this information item may be stored in a memory of the control unit. Advantageously, this memory can be read later, for example during diagnostics, and thus trigger a potential injector maintenance operation.

Furthermore, on the basis of the stored information, the control unit may also, in some embodiments of the method, carry out a so-called flow rate regulation action, namely an action enabling the expected injected quantity of fuel to be achieved in spite of the injector degradation. For example, such action may consist in modifying, within the injection command, either the total quantity of fuel to be injected, or the total duration for which the injector is open, or the injection pressure, in order to modify the static flow rate while keeping the injection time unchanged. In this way, the regulation action is advantageously able to compensate for the drift in the static flow rate as determined during the preceding steps of the method.

In the claims, the term "comprise" or "include" does not exclude other elements or steps. A single processor or several other units may be used to implement the invention. The various features described and/or claimed may advantageously be combined. Their presence in the description or in different dependent claims does not exclude this possibility. The reference signs should not be understood as limiting the scope of the invention.

The invention claimed is:

1. A method for determining a drift in the static fuel flow rate of a piezoelectric injector of a motor vehicle combustion engine, said injector comprising an electrohydraulic valve of the servo valve type designed to cause the injector to open or to close, said method comprising the following steps, executed by a control unit when the injector is open and the electrohydraulic valve is closed:

a) acquiring at least two pressure values $P_1$ and $P_2$, measured by a pressure sensor in a supply chamber of the injector at at least two respectively associated different instants $t_1$ and $t_2$;

b) calculating, from the acquired pressure values and the respectively associated instants, a gradient of pressure with respect to time dP;

c) calculating a measured static flow rate $Q_{mes}$ of which the value is equal to the gradient of pressure with respect to time dP multiplied by a first determined value $V_{sys}$ corresponding to the total volume of the fuel pressurized and divided by a second determined value K corresponding to the elastic modulus of the fuel; and d) determining a value representative of the drift in the static flow rate $Q_{ratio}$, which value is proportional to the ratio of the measured static flow rate $Q_{mes}$ to a third determined value $Q_{nominal}$ corresponding to the nominal flow rate of the injector within the range of pressure values of the gradient of pressure with respect to time dP, and storing, in a memory of the control unit, an information item representative of the drift in the static flow rate which information item is associated with said value representative of the drift in the static flow rate.

2. The method as claimed in claim 1, further comprising, prior to execution of steps a), b), c) and d) of the method, the checking, by the control unit, of a plurality of conditions of activation of the method and wherein steps a), b), c) and d) of the method are executed if, and only if, all of the conditions of execution of the method are met.

3. The method as claimed in claim 2, wherein the conditions of execution of the method comprises:

the fact that the temperature TCO of the water in the cooling circuit has a value comprised between determined limit values;

the fact that the temperature of the fuel has a value comprised between determined limit values;

the fact that the pressure of the fuel has a value comprised between determined limit values;

the fact that the quantity of fuel required for injection has a value comprised between determined limit values; and the fact that the angular position of the crankshaft of the combustion engine has a value comprised between determined limit values.

4. The method as claimed in claim 1, further comprising, prior to execution of steps a), b), c) and d) of the method, on the basis of a determined injection command from the control unit, comparing the theoretical duration comprised between the closing of the electrohydraulic valve and the closing of the injector against a determined threshold value, and wherein steps a), b), c) and d) of the method are executed if, and only if, said theoretical duration is greater than said determined threshold value.

5. The method as claimed in claim 1, wherein, during step c), the pressure gradient with respect to time is calculated using a calculation method employing a linear regression model.

6. The method as claimed in claim 1, further comprising, consecutive to step d), carrying-out, by the control unit, a flow rate regulating action within an injection command, the total quantity of fuel to be injected, the total duration for which the injector is open, or the injection pressure.

7. The method as claimed in claim 1, wherein the value representatives of the drift in the static flow rate $Q_{ratio}$ is calculated as the value of the measured static flow rate $Q_{mes}$ divided by the determined value $Q_{nominal}$ corresponding to the normal flow rate of the injector within the range of pressure values of the gradient of pressure with respect to time dP.

8. The method as claimed in claim 7, wherein the determined value $Q_{nominal}$ corresponding to the nominal flow rate of the injector within the range of pressure values of the gradient of pressure with respect to time dP is obtained from laboratory characterization of the properties of a plurality of injectors substantially identical to the injector that is the subject of the steps of the method.

9. The method as claimed in claim 1, wherein the value representative of the drift in the static flow rate $Q_{ratio}$ is calculated as the total measured area of the injector holes $A_{mes}$ divided by the total nominal area of the injector holes $A_{nominal}$, and wherein the value of sad total measured area of the injector holes $A_{mes}$ is equal to $A_{mes}=Q_{mes}/Cd\times\sqrt{(\rho/(2\times\Delta P))}$, where Cd is the coefficient of discharge characterizing the efficiency of the flow, ρ is the density of the fuel which is dependent on the temperature and on the pressure of the fuel, and ΔP is the difference between the pressure measured in the supply chamber and that measured in the combustion chamber and said total nominal area of the injector holes $A_{nominal}$ is determined from data supplied by the injector manufacturer.

10. The method as claimed in claim 1, wherein, during step a), the acquisition of pressure values is carried out throughout the duration comprised between the closing of the electrohydraulic valve and the closing of the injector, at a determined acquisition frequency.

11. A device for determining a drift in the static fuel flow rate of a piezoelectric injector of a motor vehicle combustion engine, said injector comprising an electrohydraulic valve of the servo valve type designed to cause the injector to open or to close, said device comprising a control unit, a pressure sensor in a supply chamber of the injector said control unit comprising means for implementing all the steps of the method as claimed in claim 1.

12. A non-transitory computer-readable medium on which is stored a computer program comprising instructions which, when loaded into the memory of the device of claim 11 and executed by a processor of said device, causes a computer to implement all the steps of a method for determining a drift in the static fuel flow rate of a piezoelectric injector of a motor vehicle combustion engine, said injector comprising an electrohydraulic valve of the servo valve type designed to cause the injector to open or to close, said method comprising the following steps, executed by a control unit when the injector is open and the electrohydraulic valve is closed:

a) acquiring at least two pressure values $P_1$ and $P_2$, measured by a pressure sensor in a supply chamber of the injector at at least two respectively associated different instants $t_1$ and $t_2$;

b) calculating, from the acquired pressure values and the respectively associated instants, a gradient of pressure with respect to time dP;

c) calculating a measured static flow rate $Q_{mes}$ of which the value is equal to the gradient of pressure with respect to time dP multiplied by a first determined value $V_{sys}$ corresponding to the total volume of the fuel pressurized and divided by a second determined value K corresponding to the elastic modulus of the fuel; and d) determining a value representative of the drift in the static flow rate $Q_{ratio}$, which value is proportional to the ratio of the measured static flow rate $Q_{mes}$ to a third determined value $Q_{nominal}$ corresponding to the nominal flow rate of the injector within the range of pressure values of the gradient of pressure with respect to time dP, and storing, in a memory of the control unit, an information item representative of the drift in the static flow rate which information item is associated with said value representative of the drift in the static flow rate.

13. An injection system comprising a pump, a connecting line, a supply chamber, a supply line, a piezoinjector and a control unit all suited to implementing all the steps of the method as claimed in claim 1.

14. The method as claimed in claim 2, further comprising, prior to execution of steps a), b), c) and d) of the method, on the basis of a determined injection command from the control unit, comparing the theoretical duration comprised between the closing of the electrohydraulic valve and the closing of the injector against a determined threshold value, and wherein steps a), b), c) and d) of the method are executed if, and only if, said theoretical duration is greater than said determined threshold value.

15. The method as claimed in claim 3, further comprising, prior to execution of steps a), b), c) and d) of the method, on the basis of a determined injection command from the control unit, comparing the theoretical duration comprised between the closing of the electrohydraulic valve and the closing of the injector against a determined threshold value, and wherein steps a), b), c) and d) of the method are executed if, and only if, said theoretical duration is greater than said determined threshold value.

16. The method as claimed in claim 2, wherein, during step c), the pressure gradient with respect to time is calculated using a calculation method employing a linear regression model.

17. The method as claimed in claim 3, wherein, during step c), the pressure gradient with respect to time is calculated using a calculation method employing a linear regression model.

18. The method as claimed in claim 4, wherein, during step c), the pressure gradient with respect to time is calculated using a calculation method employing a linear regression model.

19. The method as claimed in claim 2, further comprising, consecutive to step d), carrying-out, by the control unit, a flow rate regulating action within an injection command, the total quantity of fuel to be injected, the total duration for which the injector is open, or the injection pressure.

20. The method as claimed in claim 3, further comprising, consecutive to step d), carrying-out, by the control unit, a flow rate regulating action within an injection command, the total quantity of fuel to be injected, the total duration for which the injector is open, or the injection pressure.

* * * * *